US005397216A

United States Patent [19]

Kreitmeier

[11] Patent Number: 5,397,216

[45] Date of Patent: Mar. 14, 1995

[54] FLOW DIVIDER FOR RADIAL-AXIAL INLET HOUSINGS

[75] Inventor: Franz Kreitmeier, Baden, Switzerland

[73] Assignee: Asea Brown Boveri Ltd., Baden, Switzerland

[21] Appl. No.: 138,095

[22] Filed: Oct. 20, 1993

[30] Foreign Application Priority Data

Oct. 26, 1992 [EP] European Pat. Off. ..... 92118293

[51] Int. Cl.[6] ..... F01D 9/02

[52] U.S. Cl. ..... 415/193; 415/185

[58] Field of Search ..... 415/183, 184, 185, 193, 415/198.1, 199.5

[56] References Cited

U.S. PATENT DOCUMENTS

| | | | |
|---|---|---|---|
| 2,187,788 | 1/1940 | Kraft | 415/185 |
| 3,471,080 | 10/1969 | Gray . | |
| 3,930,753 | 1/1976 | Foa . | |
| 4,799,857 | 1/1989 | Bauer et al. | 415/185 |

FOREIGN PATENT DOCUMENTS

| | | | |
|---|---|---|---|
| 1160124 | 7/1958 | France | 415/199.5 |
| 966975 | 9/1957 | Germany . | |
| 2217213 | 11/1972 | Germany | 415/183 |
| 3117515A | 4/1982 | Germany . | |

*Primary Examiner*—Edward K. Look
*Assistant Examiner*—James A. Larson
*Attorney, Agent, or Firm*—Burns, Doane, Swecker & Mathis

[57] ABSTRACT

In a radial-axial inlet housing of rotating thermal machines, a flow divider is disposed in the turbine or compressor inlet, in front of the inlet and opposite the first turbine guide vane row or the compressor ribs. The flow divider in this case is disposed in the central lower stagnation point of the housing flow. It has a thick-headed profile with a straight median line. The rear side of the flow divider, seen in the direction of flow, is disposed perpendicularly to the rotary shaft at a distance from the first guide vane row or the ribs. There is a gap between the radially inner side of the flow divider and the housing wall, and the chord length of the flow divider decreases radially outwardly. The leading edge of the flow divider, seen in the direction of flow, is inclined like a straightened potential line relative to the housing wall.

11 Claims, 2 Drawing Sheets

FLOW DIVIDER FOR RADIAL-AXIAL INLET HOUSINGS

FIELD OF THE INVENTION

The invention relates to a flow divider for radial-axial inlet housings of rotating thermal machines.

BACKGROUND OF THE INVENTION

Flow dividers of this type are known. Their function is to stabilize the flow before it reaches the first guidance bank of the machine.

A gas turbine is known that has a hot-gas housing with a tapered lower part, in which a large, plate-shaped, cooled flow divider disposed in an area with a low speed is used for stabilizing the flow. The disadvantage of this solution is periodic overflows because of the low flow speed. Moreover, the production costs of the thermal machine are high because of the tapering on the lower part of the hot-gas housing. A further disadvantage is that, as a consequence of the large dimensions of the flow divider, a relatively large quantity of cooling air is used, resulting in increases in non-homogenities in temperature and the $NO_x$ values.

A roof-shaped or butterfly-shaped flow divider is also known that is disposed in a hot-gas housing without a tapered lower part. With this known solution the overflow cross-section is very large, which can lead to periodic instabilities. The roof-shaped flow divider is located in the area with a lower flow speed; thus, the stabilizing effect is weak. Further disadvantages are the expensive production and high cooling air consumption because of the exceptionally large dimensions of the flow divider. The latter results in this case in higher non-homogenities in temperatures and higher $NO_x$ values.

OBJECT AND SUMMARY OF THE INVENTION

The invention attempts to avoid all of these disadvantages. The object of the invention is to create a flow divider to be used in a rotating thermal machine with a radial-axial inlet housing that effects extensive stabilization of the flow, prevents or hinders an overflow, requires minimal quantities of cooling air, is inexpensive to produce, and can even be used with inlet housings without a tapered lower part.

This is achieved in accordance with the invention in that the flow divider is disposed in the turbine inlet, opposite the lead-in in front of the first guidance bank or, in the compressor inlet, opposite the inlet in front of the ribs; that the flow divider is disposed in the central lower stagnation point of the housing flow; that the flow divider has a thick-headed profile with a maximum profile thickness ($d_{max}$) and a straight median line; that the rear side of the flow divider in the flow direction is disposed perpendicularly to the rotary shaft at a distance from the first guidance bank or the ribs; that there is an action existing between the inner side of the flow divider, seen in the radial direction, and the housing wall, and the chord length of the flow divider decreases outwardly from the inside, and that the front side of the flow divider in the flow direction is inclined like a straightened potential line.

Some of the advantages of the invention are that an extensive stabilizing effect on the flow is achieved, thus increasing the effectiveness of the installation, and that only small quantities of cooling air are required, which is manifested in a decrease in the non-homogenities of temperature and of the $NO_x$ values. Moreover, radial-axial inlet housings without a tapered lower part can also be used, hence reducing costs.

It is particularly useful when the profile of the flow divider is similar to the profile of the first turbine guidance bank or the ribs, and the maximum profile thickness $d_{max}$ is independent of the radius, and is therefore constant across the entire height of the flow divider.

It is also advantageous when the ratio of the maximum profile thickness $d_{max}$ to the chord length of the flow divider is 1/6 at the hub, and the distance between the flow divider and the first guidance bank or ribs is $\frac{1}{4}$ of the blade pitch t of the first guide vane row bank or rib.

Furthermore, it is advantageous when the outer side of the flow divider in the turbine inlet, seen in the radial direction, has a maximum width equal to the heat accumulation segment disposed underneath, and the flow divider can be cooled with cooling air supplied via the heat accumulation segment.

The circular position of the flow divider, seen in the flow direction, is a function of the oblique flow characteristic of the first turbine guide vane row or the ribs.

BRIEF DESCRIPTION OF THE DRAWINGS

Two exemplary embodiments of the invention are shown by means of a single-shaft gas turbine with axial flow-through illustrated in the drawings, in which.

DETAILED DESCRIPTION OF THE PREFERRED EMBODIMENTS

Only the elements essential for understanding the invention are shown. The flow direction of the cooling air is indicated by arrows.

Figure 1:
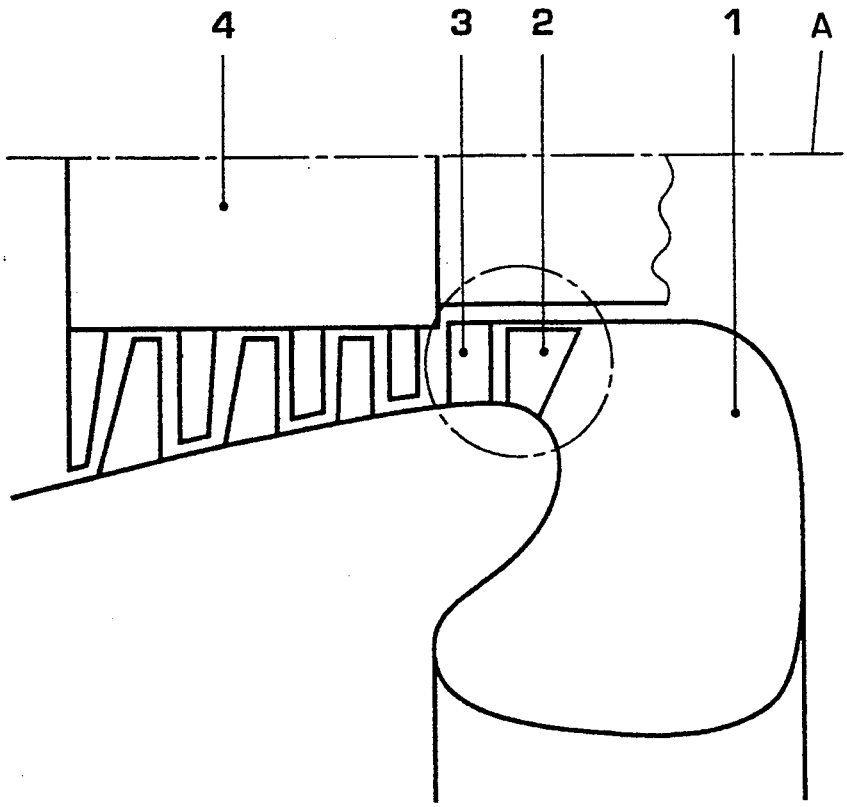
FIG. 1 is a partial longitudinal section of the turbine.
Figure 2:
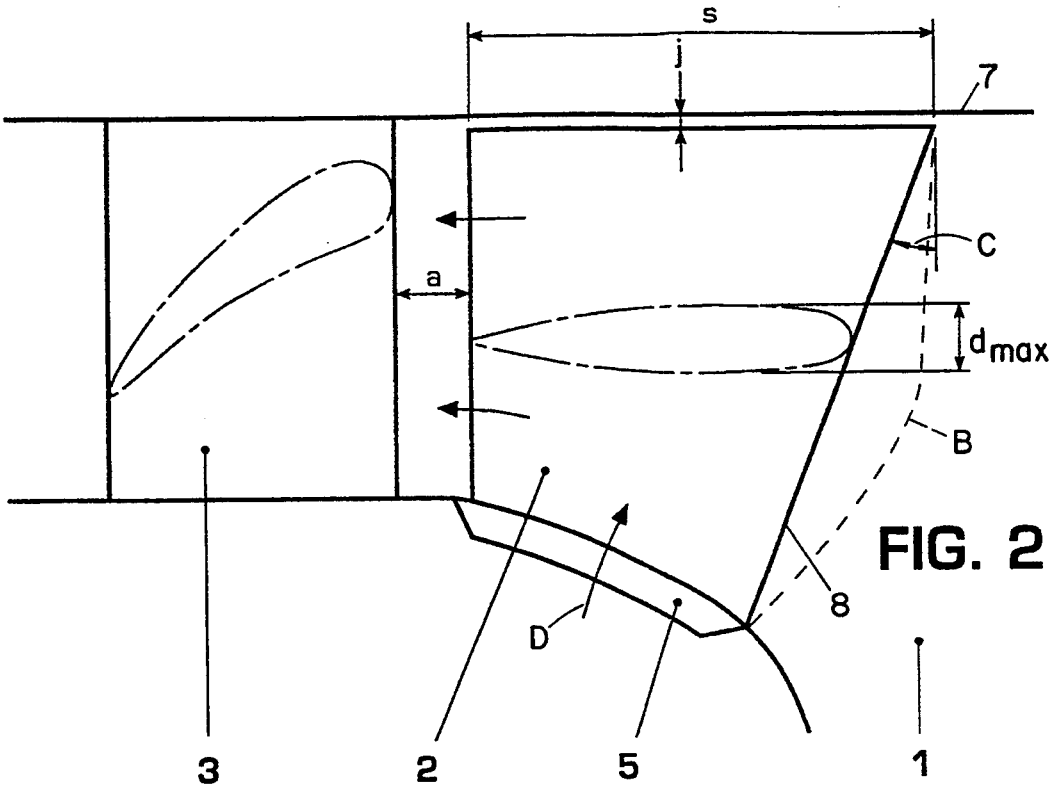
FIG. 2 is an enlarged partial longitudinal section of the hot-gas housing with the flow divider.
Figure 3:
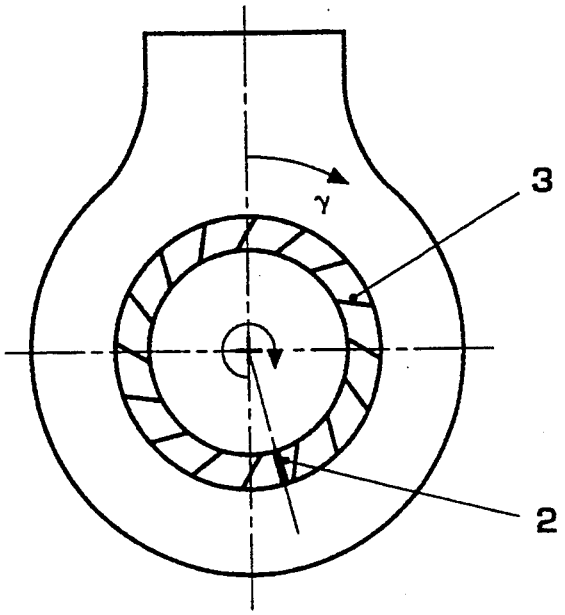
FIG. 3 is the schematic representation of the circular position of the flow divider, seen in the flow direction.

FIG. 1 is an exemplary embodiment a partial longitudinal section of a gas turbine showing a portion of the turbine below the axis A of the rotor 4. FIG. 2 is a section showing the flow divider in the hot-gas housing of the turbine in an enlargement. In accordance with the invention, the flow divider 2 is mounted opposite the inlet, in front of the first turbine guide vane row 3. The flow divider 2 is disposed in the central lower stagnation point of the housing flow. Because the circular position of the flow divider 2 is a function of the oblique flow characteristic of the first guide vane row 3, the lower stagnation point is displaced with the use of curved blades, as shown in FIG. 2, by approximately 3° counter to the direction of rotation of the rotor 4, that is, $\gamma < 180°$ (see FIG. 3). If the flow divider were to be disposed at a circular angle of $\gamma = 180°$, it would be overflowed The flow divider 2 has a thick-headed profile with a straight median line. As seen in FIG. 2, the profile of the flow divider 2 is similar to the profile of the first turbine guide vane row 3, in the manner the thickness d varies over the chord length, being thicker in the leading portion and tapering to a narrowed point at the trailing end. The maximum profile thickness $d_{max}$ is constant across the entire height of the flow divider. In our exemplary embodiment $d_{max}=30$ mm.

The radially outer side of the flow divider 2 opposite the rotor axis A has a maximum width equal to the heat accumulation segment 5 located underneath. A gap j is provided between the radially inner side of the flow divider 2, seen in the radial direction, and the housing wall 7; this gap is only as great as is necessary for differential expansions caused by temperature fluctuations. The chord length s of the flow divider 2 is six times $d_{max}$ at the radially inner side, which in our example is 180 mm. The broken line illustrates a potential line B. A leading edge 8 of the flow divider is inclined at an angle c with respect to a radial plane perpendicular to the housing wall 7. The leading edge 8 is formed as a straight line connecting the end points of the potential line B. The angle between the leading edge of the flow divider 2 and a radial plane perpendicular to housing wall is 23°.

The distance a from the flow divider 2 to the first guidance bank 3 is $\frac{1}{4}$ of the blade pitch t of the first guidance bank 3. With a blade pitch of t=120 mm, in our example the distance a=30 mm.

The flow divider 2 opposite the lead-in in the turbine inlet is supplied with cooling air during operation. This is supplied through small conduits via the heat accumulation segment 5, for example, as illustrated by arrow B.

The flow divider 2 of the invention has a number of advantages. Its stabilizing effect is substantial, because it is located in the area of higher flow speed. The cross-section of the flow divider 2 in the circular direction is only 4 to 5% of the total cross-section. Because of its small size, the cooling air requirement is minimal; hence, the $NO_x$ values and non-homogenities in temperature are very low. Because an overflow of the flow divider 2 is not possible, only minimal non-homogenities in flow are present before the first turbine guidance bank 3. A further advantage is that it is no longer necessary to taper the lower part of the hot-gas housing. This rotationally symmetrical shell is inexpensive to manufacture. The flow divider 2 itself can likewise be manufactured at low cost.

Figure 4:
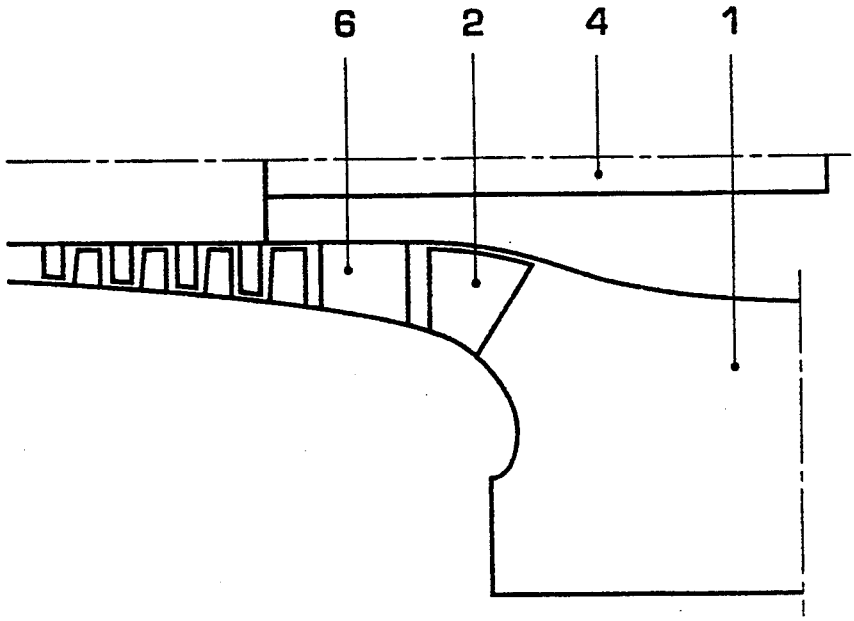
FIG. 4 is a partial longitudinal section of the compressor.

The above description also applies in the same sense to the exemplary embodiment shown in FIG. 4. Here the flow divider 2 is disposed directly in front of the rib 6, opposite the inlet in the compressor inlet. In contrast to exemplary embodiment of FIG. 1, in this example the circular position of the flow divider 2 is characterized by an angle of $\gamma=180°$, because in the case of axially-oriented, straight ribs 6, the lower stagnation point is located there.

While this invention has been illustrated and described in accordance with preferred embodiments, it is recognized that variations and changes may be made therein without departing from the invention as set forth in the claims.

It is claimed:

1. A flow divider in a radial-axial inlet housing of a rotating thermal machine having a rotor comprising:

a flow divider disposed opposite one of a turbine inlet in front of a first guide vane row, and a compressor inlet in front of ribs;

the flow divider being disposed in a central lower stagnation point of a housing flow;

the flow divider having a profile that is thicker in a head portion and tapering at a rear portion and a straight median line;

a rear edge of the flow divider in the direction of flow being disposed perpendicular to a rotor axis at a predetermined distance from one of the first guide vane row and the ribs;

the height of the flow divider being selected so that there is a gap between a radially inner side of the flow divider and a housing wall;

a chord length of the flow divider decreasing continuously from the radial inner side outwardly; and a leading edge of the flow divider in the direction of flow inclined relative to a radial plane.

2. The flow divider as claimed in claim 1, wherein the flow divider is disposed in front of the first turbine guide vane row and the profile of the flow divider is formed to vary in thickness over the chord length as does the profile of the first turbine guide vane row.

3. The flow divider as claimed in claim 1, wherein a maximum profile thickness is constant across the entire height of the flow divider.

4. The flow divider as claimed in claim 1, wherein a ratio of the maximum profile thickness to a chord length of the flow divider is 1/6 at the radially inner side of the flow divider.

5. The flow divider as claimed in claim 1, wherein the flow divider is disposed in front of the first turbine guide vane row and a distance between the flow divider and the first guide vane row is $\frac{1}{4}$ of a blade pitch of the first guide vane row.

6. The flow divider as claimed in claim 1, wherein the flow divider is disposed in front of the first turbine guide vane row and a radially outer side of the flow divider has a maximum width in the turbine inlet equal to a heat accumulation segment on which the flow divider is mounted, and the flow divider is cooled with cooling air guided via the heat accumulation segment.

7. The flow divider as claimed in claim 1, wherein the flow divider is disposed in front of the first turbine guide vane row and the circular position of the flow divider, in reference to the flow direction, is determined by the oblique flow characteristic of the first turbine guide vane row to be less than 180° from a top center position of the rotor in a rotation direction.

8. The flow divider as claimed in claim 1, wherein the leading edge of the flow divider and the radial plane form an angle of 23 degrees.

9. The flow divider as claimed in claim 1, wherein the flow divider is disposed in front of the ribs at the compressor inlet and the profile of the flow divider is formed to vary in thickness over the chord length as does the profile of the ribs of the compressor.

10. The flow divider as claimed in claim 1, wherein the flow divider is disposed in front of the ribs at the compressor inlet and a distance between the flow divider and the compressor ribs is $\frac{1}{4}$ of a blade pitch of the compressor ribs.

11. The flow divider as claimed in claim 1, wherein the flow divider is disposed in front of the ribs at the compressor inlet the circular position of the flow divider, in reference to the flow direction, is determined by the oblique flow characteristic of the compressor ribs to be the bottom center position of the rotor.

* * * * *